US009797159B2

(12) United States Patent
Breeden, III

(10) Patent No.: US 9,797,159 B2
(45) Date of Patent: Oct. 24, 2017

(54) T-POST INSTALLATION TOOL

(71) Applicant: George Breeden, III, Durant, OK (US)

(72) Inventor: George Breeden, III, Durant, OK (US)

( * ) Notice: Subject to any disclaimer, the term of this patent is extended or adjusted under 35 U.S.C. 154(b) by 418 days.

(21) Appl. No.: 14/545,474

(22) Filed: May 8, 2015

(65) Prior Publication Data

US 2016/0326770 A1 Nov. 10, 2016

(51) Int. Cl.

| | |
|---|---|
| ***E04H 17/26*** | (2006.01) |
| ***E21B 7/02*** | (2006.01) |
| *E21B 19/00* | (2006.01) |
| *E02D 7/10* | (2006.01) |
| *E02D 7/16* | (2006.01) |

(52) U.S. Cl.

CPC ..... *E04H 17/263* (2013.01); *E21B 7/02* (2013.01); *E21B 7/022* (2013.01); *E02D 7/10* (2013.01); *E02D 7/16* (2013.01); *E21B 19/00* (2013.01)

(58) Field of Classification Search

CPC ... E21B 1/02; E21B 7/02; E21B 7/022; E21B 11/02; E21B 15/00; E21B 15/04; E21B 19/00; E21B 19/087; E02D 7/00; E02D 7/02; E02D 7/04; E02D 7/10; E02D 7/16; E02D 7/20; E02D 13/00; E02D 13/04; E04H 17/26; E04H 17/263; E21C 5/00; B25D 1/00; B25D 9/08

USPC ..... 173/27, 28, 25, 38, 42, 45, 53, 54, 55, 173/90, 92, 115, 132, 112, 206, 184; 254/29 R, 30, 124, 131, 127; 405/232

See application file for complete search history.

(56) References Cited

U.S. PATENT DOCUMENTS

| | | | | | |
|---|---|---|---|---|---|
| 1,569,857 | A | | 1/1926 | Farb | |
| 2,348,820 | A | | 5/1944 | Jordan | |
| 2,378,131 | A | | 6/1945 | Dirkson | |
| 2,593,186 | A | * | 4/1952 | Richardson | E04H 17/263 173/124 |
| 2,844,006 | A | | 7/1958 | Lutz | |
| 3,073,571 | A | * | 1/1963 | Wunsch | E04H 17/263 173/129 |
| 3,117,635 | A | | 1/1964 | Derrkoski | |
| 3,442,338 | A | | 5/1969 | Broderson | |
| 3,447,613 | A | * | 6/1969 | Lisenby | E02D 7/08 173/195 |
| 3,605,912 | A | * | 9/1971 | Fisher | E02D 7/16 173/112 |
| 3,712,389 | A | | 1/1973 | Smoak | |
| 3,783,953 | A | * | 1/1974 | Kopaska | E04H 17/263 173/124 |
| 4,002,210 | A | * | 1/1977 | White | E02D 7/08 173/26 |
| 4,124,081 | A | * | 11/1978 | Deike | E02D 7/10 173/147 |

(Continued)

*Primary Examiner* — Scott A. Smith
(74) *Attorney, Agent, or Firm* — Randal D. Homburg

(57) ABSTRACT

A hydraulic tool for the installation of fencing T-posts into the ground without bending the T-post or causing damage or deformity to the top of the T-post, installs to the three point hitch of a tractor with hydraulic connections to the tractor hydraulic system, securing the post along its vertical length prior to insertion into the ground, the tool having an upper stationary bracket holding an upper section of the T-post within a T-post slot and a lower sliding ram bracket securing to a lower section of the post, the lower sliding ram bracket forcing the T-post into the ground by use of a hydraulic ram at a chosen depth.

10 Claims, 12 Drawing Sheets

(56) References Cited

U.S. PATENT DOCUMENTS 4,130,168 A * 12/1978 Deike ..... E21B 7/022 173/141
4,139,067 A * 2/1979 Craig ..... A01G 17/16 173/100
4,193,459 A * 3/1980 Engstrom ..... E02D 7/02 173/127
4,494,612 A * 1/1985 Bell ..... E02D 7/04 173/1
4,665,994 A * 5/1987 Snider ..... E02D 7/04 173/128
5,375,664 A * 12/1994 McDowell ..... E02D 7/02 173/1
5,494,117 A 2/1996 Aldridge
D372,177 S * 7/1996 Hansen ..... D34/31
5,558,169 A * 9/1996 Madgwick ..... E21B 7/022 173/185
5,819,857 A * 10/1998 Rohrer ..... E04H 17/263 173/128
6,234,260 B1 * 5/2001 Coast ..... G01V 1/16 173/148
6,305,480 B1 * 10/2001 Franklin ..... E21B 1/02 173/147
6,591,919 B1 7/2003 Herrmann
6,702,037 B1 * 3/2004 Thiessen ..... E02D 7/10 173/131
6,889,777 B2 5/2005 Boley
7,063,172 B1 * 6/2006 Marentette ..... E02D 5/04 173/13
7,111,690 B2 * 9/2006 Kleinert ..... E02D 7/04 173/128
7,296,636 B1 11/2007 Vreeland
7,407,017 B2 * 8/2008 Robson ..... B28D 1/26 173/1
7,597,156 B1 10/2009 Reid
7,686,098 B2 3/2010 Tyer
7,950,470 B2 5/2011 Reid
2006/0113444 A1 6/2006 Parsons

* cited by examiner

T-POST INSTALLATION TOOL

CROSS REFERENCE TO RELATED APPLICATIONS

None.

BACKGROUND OF THE INVENTION

1. Field of Invention

A hydraulic tool for the installation of fencing T-posts into the ground without bending the T-post or causing damage or deformity to the top of the T-post, installs to the three point hitch of a tractor with hydraulic connections to the tractor hydraulic system, securing the post along its vertical length prior to insertion into the ground, the tool having an upper stationary bracket holding an upper section of the T-post within a T-post slot and a lower sliding ram bracket securing to a lower section of the post, the lower sliding ram bracket forcing the T-post into the ground by use of a hydraulic ram at a chosen depth.

2. Description of Prior Art

A preliminary review of prior art patents was conducted by the applicant which reveal prior art patents in a similar field or having similar use. However, the prior art inventions do not disclose the same or similar elements as the present T-post insertion tool, nor do they present the material components in a manner contemplated or anticipated in the prior art. They also, for the most part, address post insertion devices that push the post into the ground from the top of the post, unlike the lateral insertion means for the insertion of the present T-post installation tool, such top-of-the-post insertion increasing the chance of damage to the top of the post from impact and also the risk of bending the post during insertion.

A first set of post installation tools are found in multiple U.S. Patents, each of this patent applying a striking force on the top of the post being driven, in the same manner as a hammer strike to the top of the post. These striking force post driver patents include U.S. Pat. No. 2,844,006 to Lutz, U.S. Pat. No. 3,117,635 to Deerkoski, U.S. Pat. No. 5,494,117 to Aldridge, U.S. Pat. No. 6,889,777 to Boley, U.S. Pat. No. 7,296,636 to Vreeland, and U.S. Pat. No. 7,686,098 to Tyer. A manual hammer device slipping over the top of a post is shown in U.S. Pat. No. 3,712,389 to Smoak.

Another set of patent engage the top of the post being driven and force the post into the ground using a steady vertical force. These patent are identified in U.S. Pat. No. 6,591,919 to Herrmann and two patents to Reid, identified as U.S. Pat. Nos. 7,597,156 and 7,950,470. These patent employ the use of hydraulics to supply the driving force.

Post drivers have also disclosed guides of some nature to support a post during the installation process. In U.S. Pat. No. 2,378,131 to Dirkson, a pair of rollers are use for the smooth movement of the gear driven post long channel member. Another friction pulley is disclosed in U.S. Pat. No 2,348,820 to Jordan which provides engagement with the plate hammer of that driver which is further driven by a belt or chain and sprocket. A guide roller is supplied for contact and security of a post which is driven by the apparatus in the post driver safety latch shown in U.S. patent Publication No. 2006/0113444 to Parson. This latch has a lever which engages and disengages the rollers against the post.

A one person fence post driver is shown in U.S. Pat. No. 1,569,857 to Farb. In this patent, there are two parts which integrate to form the driving apparatus—a first tube section which is placed over the top of the T-post with a locking dog having a transversely extending head that engages the T-post on the surface having a plurality of projections between two of the projection which can be locked using a bolt. A second component slips over the first tube section and is slid up and down to drive the post into the ground until two hands can be used to complete the T-post installation. This was the only other patent found which has some engagement with the lateral surface of a T-post to avoid a direct and potentially deforming impact to the top of the T-post. It provides basically a type of impact hammering device, however and must be installed over the top of the T-post prior to the driving of the T-post using this manual device.

SUMMARY OF THE INVENTION

T-post fencing is currently the most expeditious and cost effective means of supplying fencing in the agricultural industry for containment of livestock using wire fencing. It is also used for roadside marking, for erection of snow fencing and for temporary confinement of animals in small areas using fencing panels. A common T-post, as referenced in the present application, is generally supplied in a length of six to seven feet, defines a T cross-section (hence the name "T-post) with a flat side having a plurality of wire supports (Reid '156 and '470), or flanges (T-post 17 in Herrmann '919) on the flat lateral side indicating the top of the "T" in the T-post cross section. These flanges are used to secure a vertically placed wire tied to the post from being raised or lowered along the vertical axis of the post once secured.

Of the prior art T-post installation tools, most of them involve an impact on the upper end of the T-post or they insert over the top of the T-post to engage some downward force on the top end of the post. These type forces pose two major potential issues during installation—deformation of the T-post and injury to the user. As to deformation, impact on the top of the T-post with some type of hammering tool can misshape the top of the T-post, bending the upper end or causing it to flare. Over time, this can cause to post to decay faster or split longitudinally. Impact removes the paint on the metal T-post and promotes rust build-up. Impact can also bend the T-post at some point between the upper and lower end when the T-post is installed in hard ground. As to the injury potential, there is always a chance for a user to get their hand between the driver and the T-post, to have the impact cause a lateral shift of the T-post while the post is being held, or to bend in the direction of the user's position during installation. There is also the risk of getting a hand or glove caught between the installation tool and the T-post in the devices that insert over the top of the T-post which could lead to a crushing type or pinching type injury to the user's hand.

It would therefore be preferred that the user is no exposed to impact or any requirement to actually hold the T-post during installation. It would also be preferred that the installation tool be presented in a manner that would cause little or no damage to the T-post, preserving the shape and integrity of the T-post.

DESCRIPTION OF THE DRAWINGS

The following drawings are submitted with this utility patent application.

FIG. 6 is an isolated view of the pivotal joint assembly of the tower support member between the horizontal support arm and the lower vertical insert section with the spring locking pin disengaged.

FIG. 9 is an exploded view of the T-post installation tool.

DESCRIPTION OF THE PREFERRED EMBODIMENT

Figure 5:
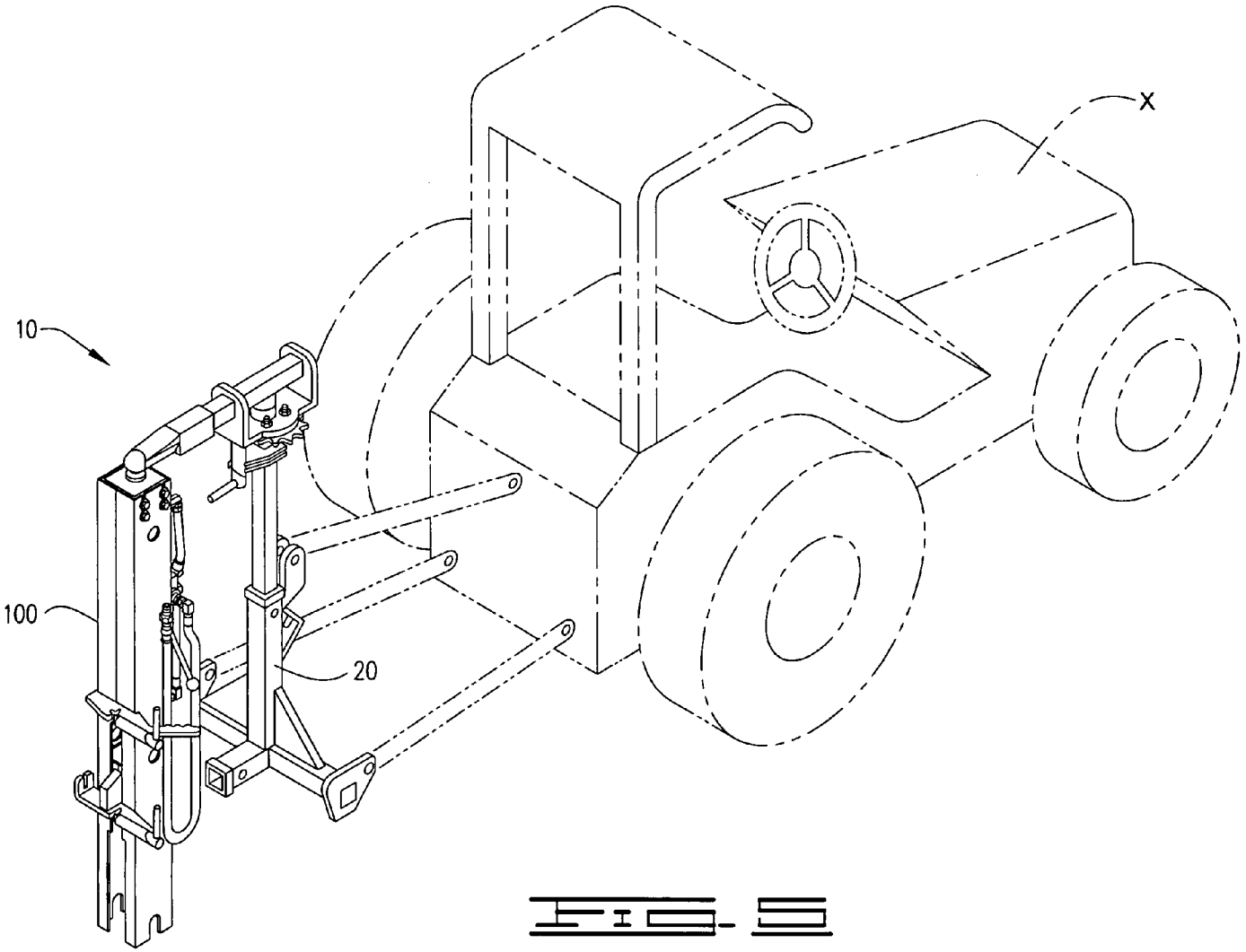
FIG. 5 is a rear perspective view of the T-post installation tool attached to a three point hitch of a tractor.
Figure 5:
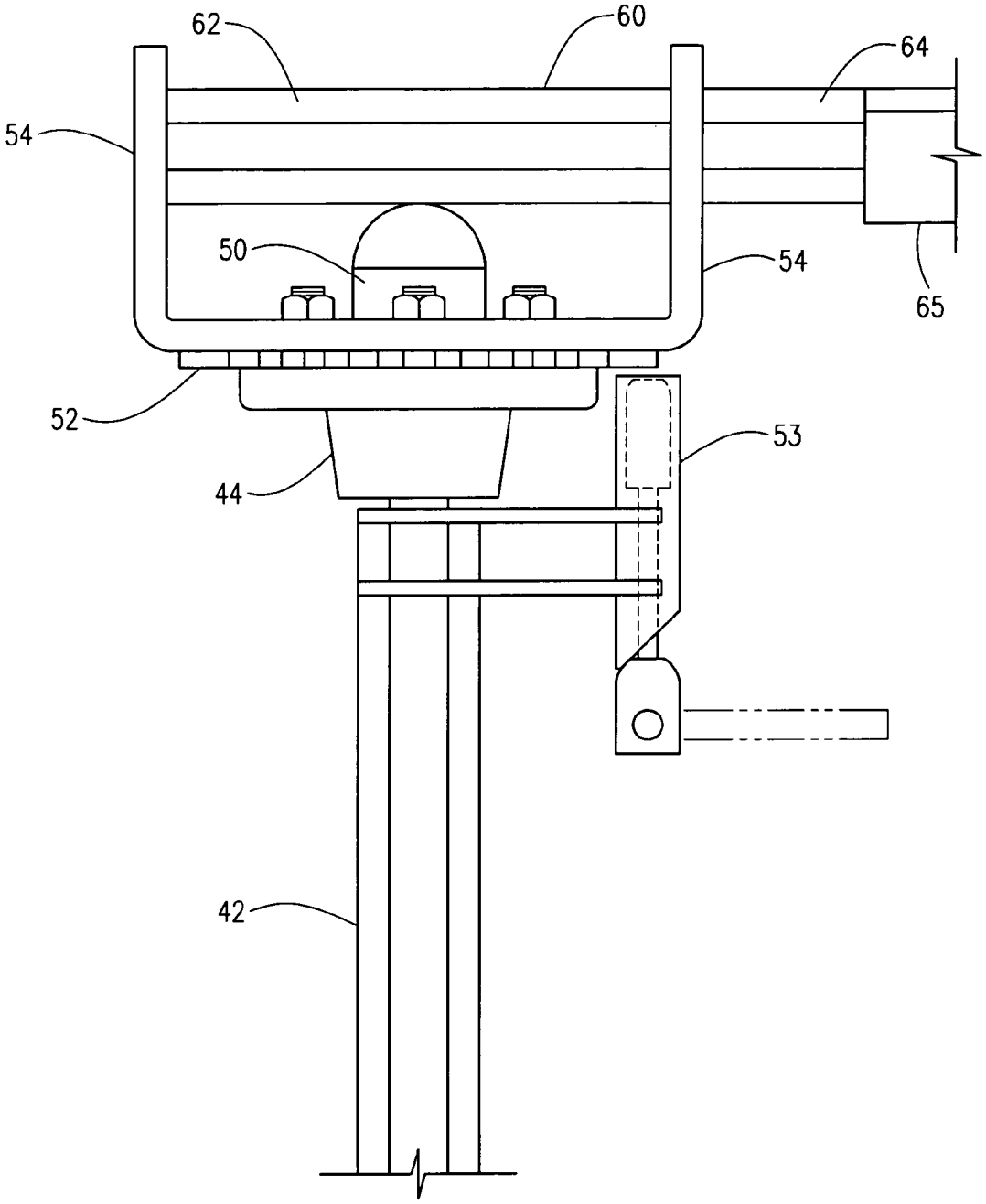
Figure 7:
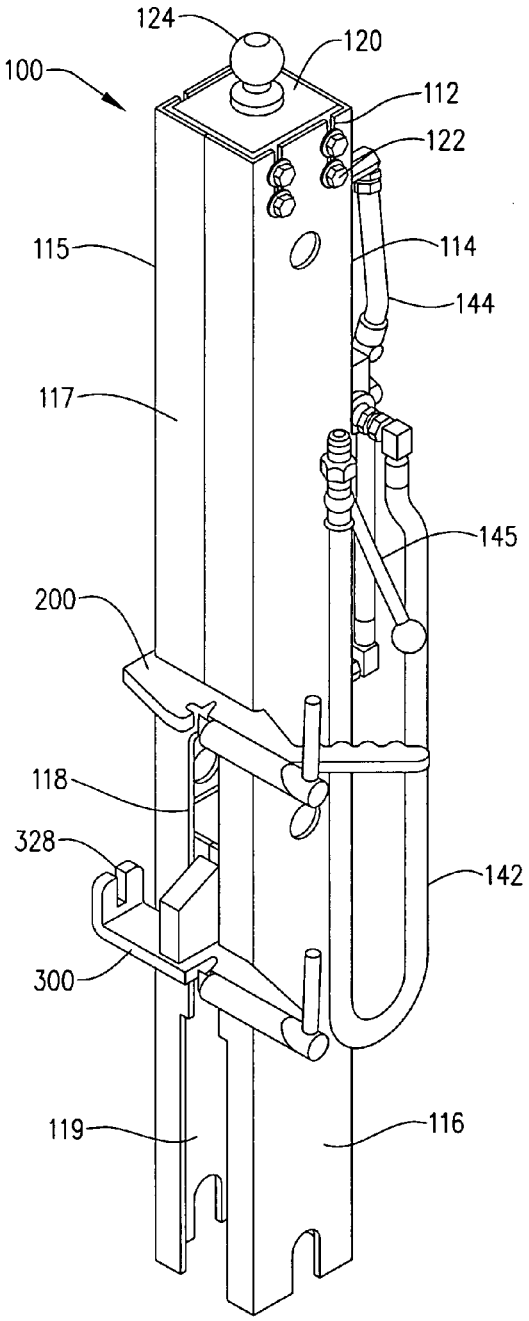
FIG. 7 is an upper perspective view of the hydraulic ram assembly in a raised position.
Figure 8:
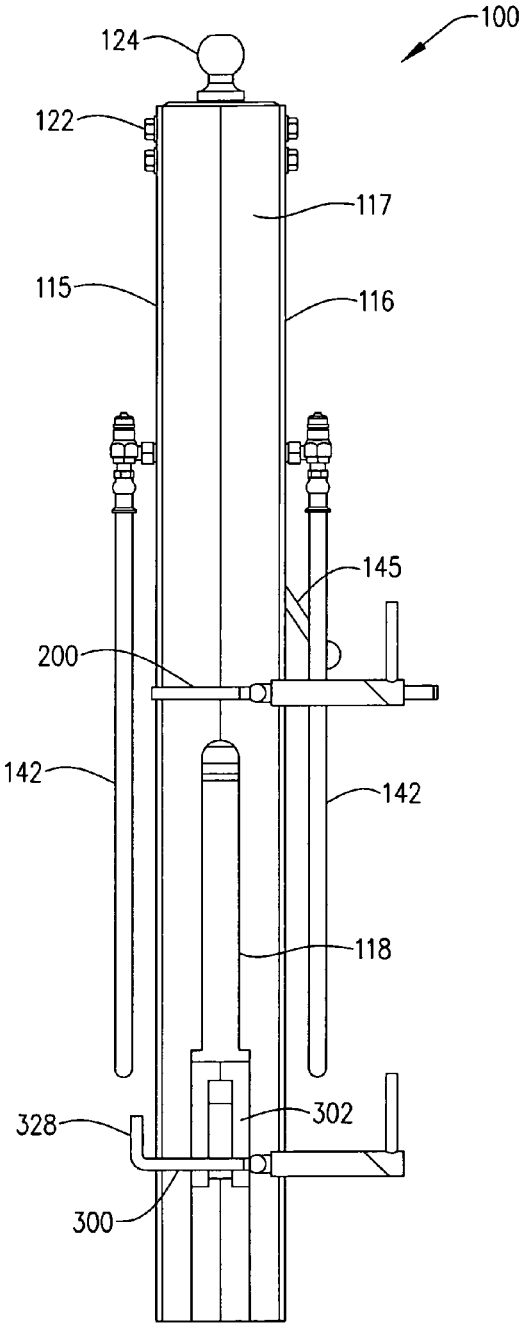
FIG. 8 is a rear view of the hydraulic ram assembly in a lowered position.
Figure 3:
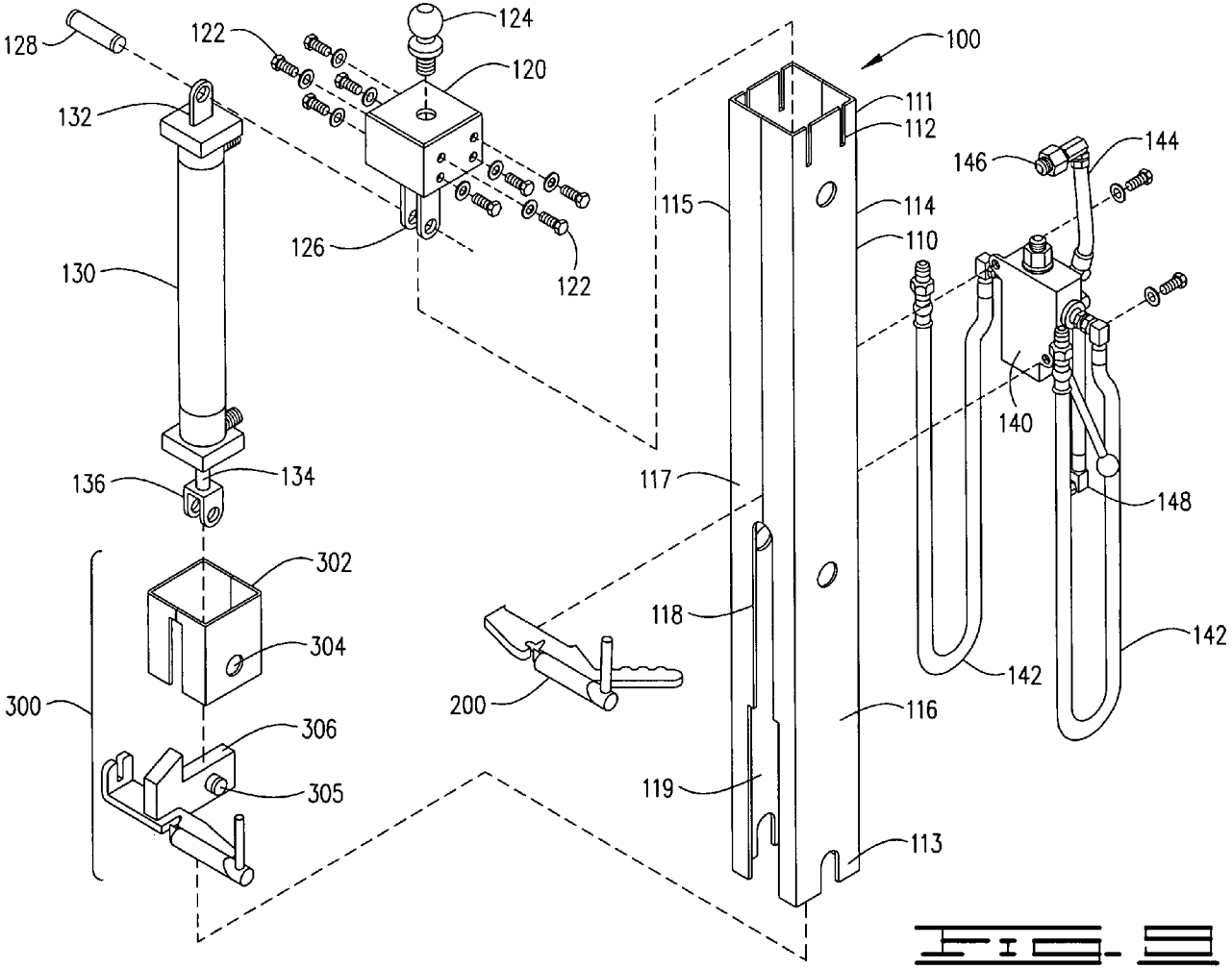
Figure 10:
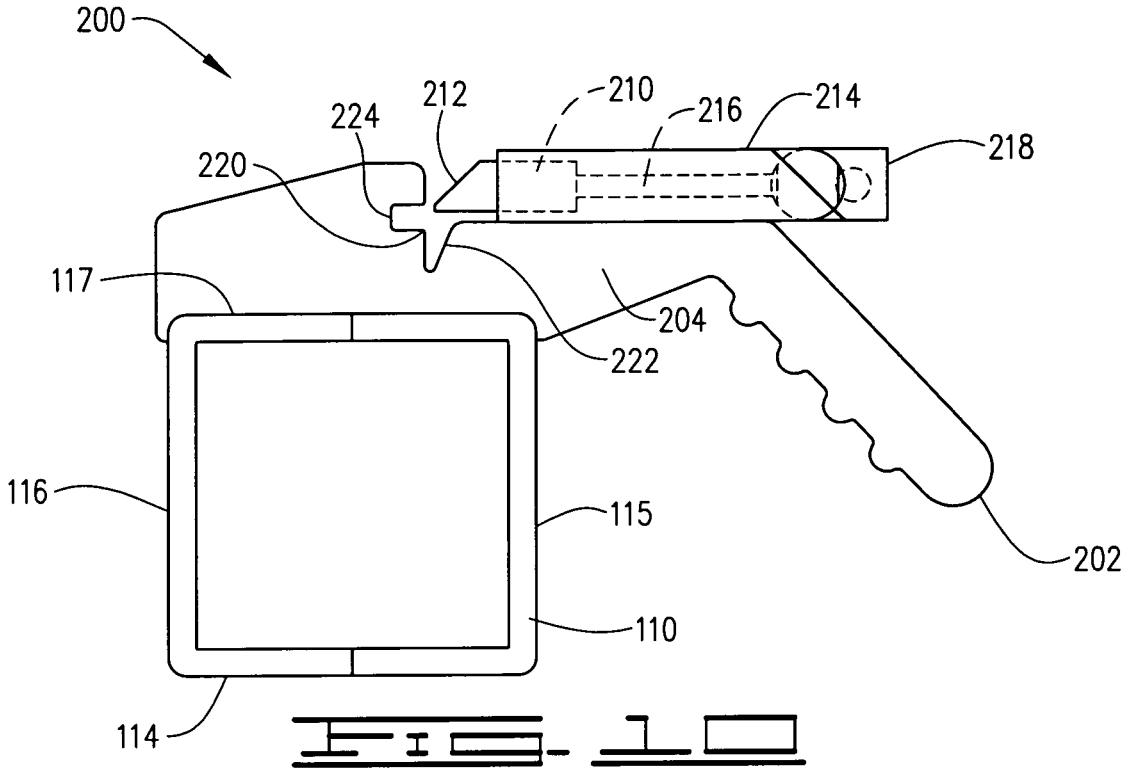
FIG. 10 is a top view of the upper stationary T-post latch assembly in a closed position.
Figure 11:
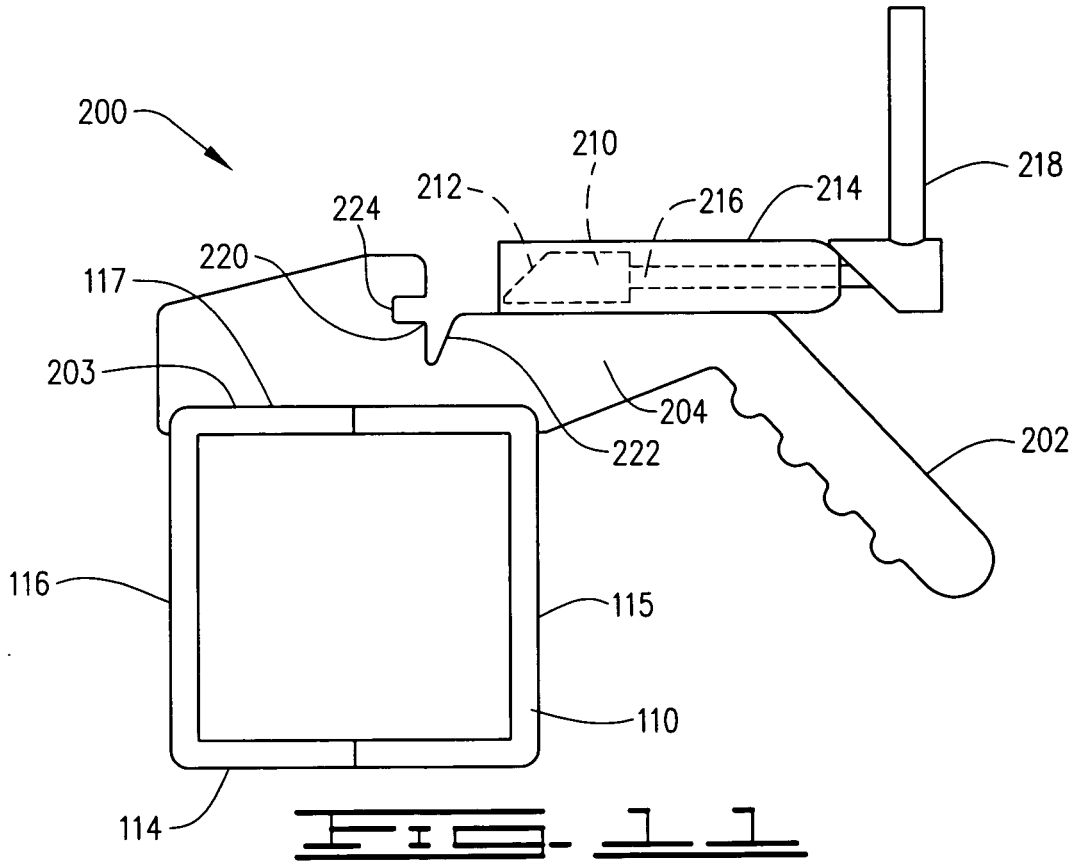
FIG. 11 is a top view of the upper stationary T-post latch assembly in an open position.

A T-post installation tool 10, attaching to the rear end of a tractor having a three point hitch and having hydraulic line connections, shown in FIGS. 1-16 of the above drawing sheets, presents the tool for driving a T-post A into the ground without impact and with little or no potential for deformation to the T-post A, the tool 10 comprising a tower support member 20 attaching to the three point hitch of the tractor X, FIG. 5, providing a locking ball hitch 65 pivotally engaging an upper hitch ball 124 suspending a hydraulic ram assembly 100.

The T-post A intended for use with the tool 10 are referenced herein as a common "T-post", shown in FIGS. 1-4 and 13-14 of the drawings, generally supplied in a length of six to seven feet, defining a "T" cross-section (hence the name "T-post) formed by two lateral side sections B, a rear section C and a flat front surface D having a plurality of wire supports (Reid '156 and '470), flanges (T-post #17 in Herrmann '919) or in the present specification, extending projections E, extending from the flat front surface D perpendicular to the two extending lateral sides B, a lower twist plate F and a top end G and bottom end H which is inserted into the ground along with the twist plate F. The extending projections E are used to secure a vertically placed wire tied to the post from being raised or lowered along the vertical axis of the T-post once secured. Relying on this definition, the T-post used in the drawings and Claims will be defined as the T-post above.

Figure 1:
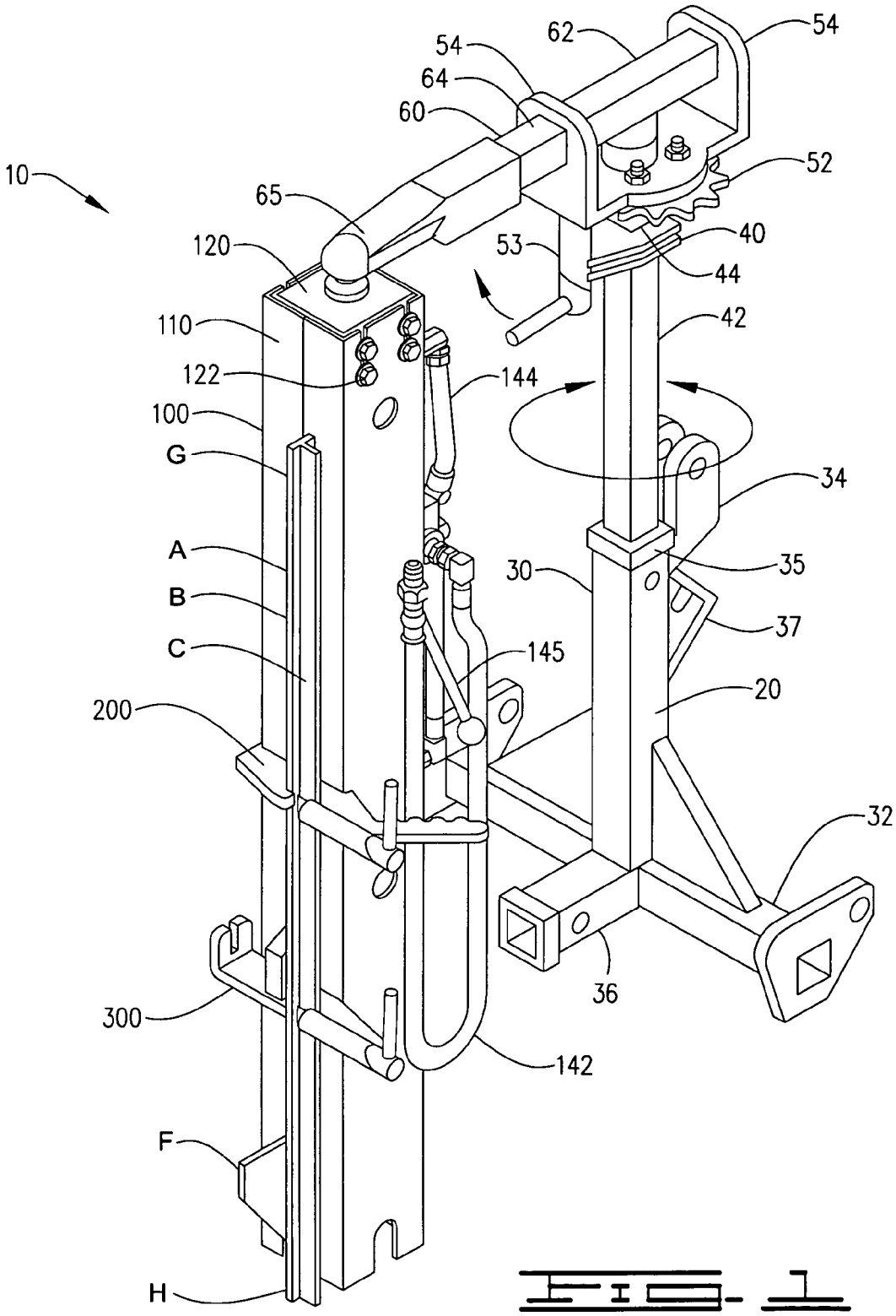
FIG. 1 is a rear perspective view of the T-post installation tool with a T-post.
Figure 2:
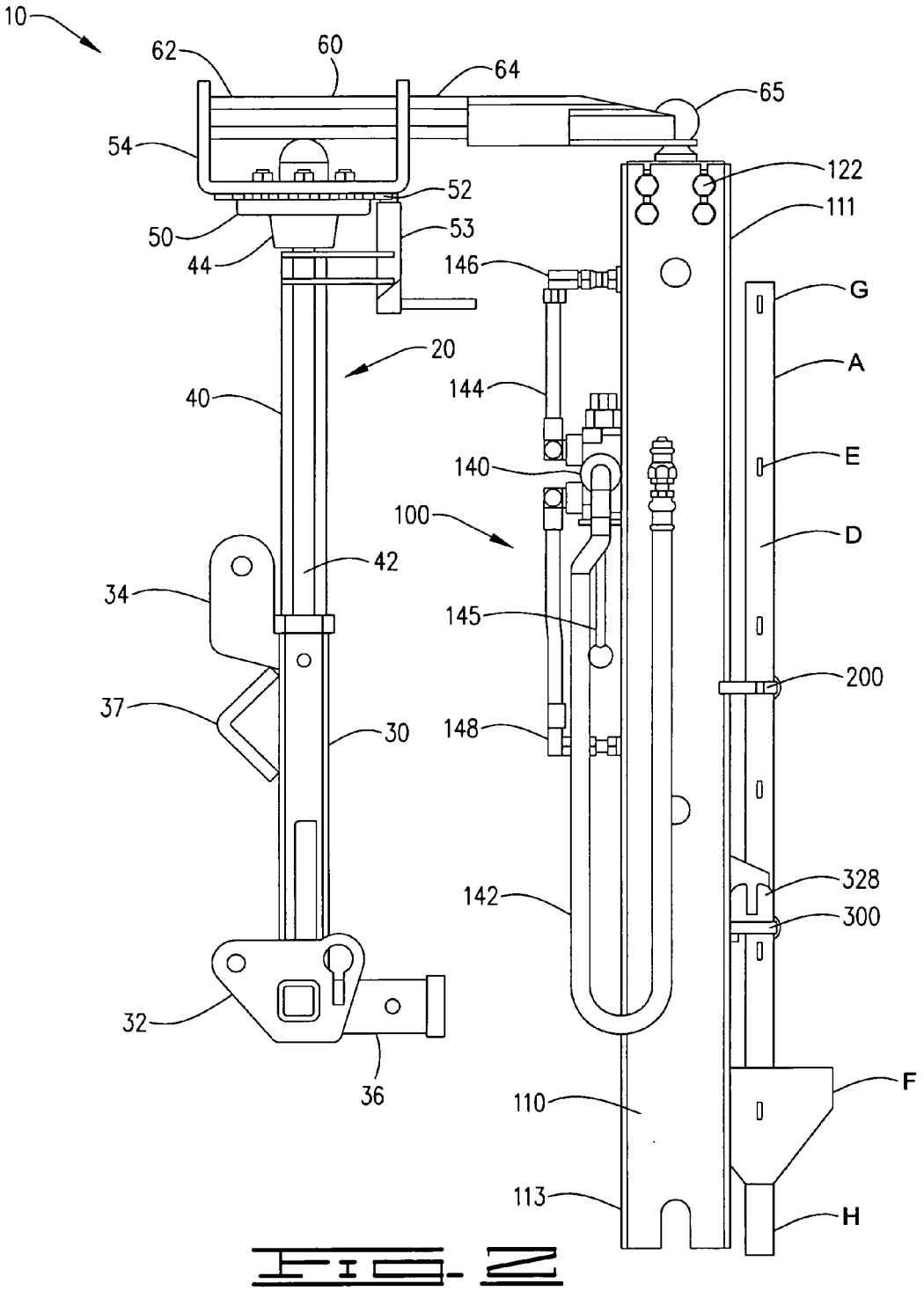
FIG. 2 is a side view of the T-post installation tool indicating the connecting components between the tower support member and the hydraulic ram assembly, with a T-post attached within upper stationary T-post latch assembly and the lower drive T-post latch assembly.
Figure 3:
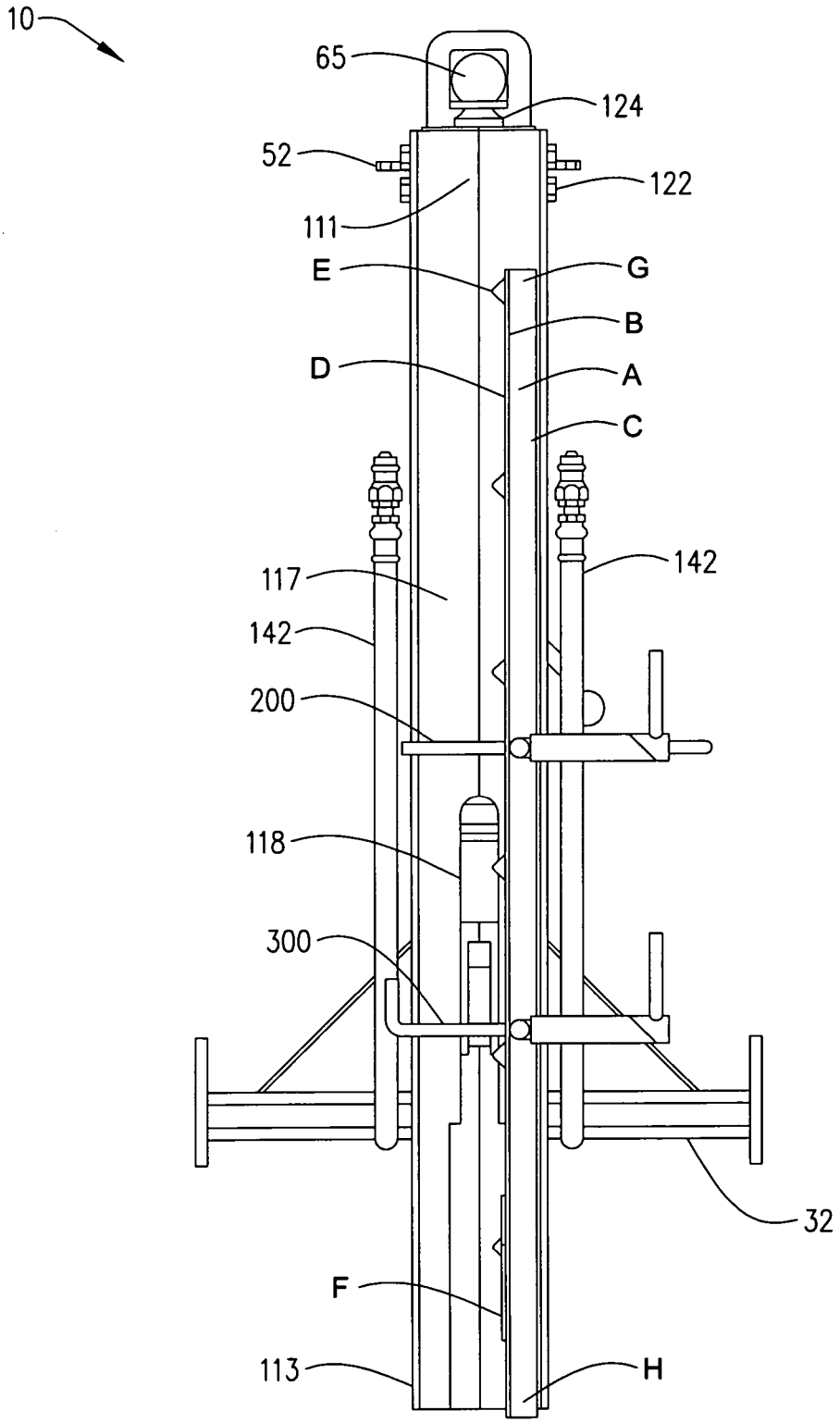
FIG. 3 is a rear view of the T-post installation tool with a T-post in a position to be driven.
Figure 4:
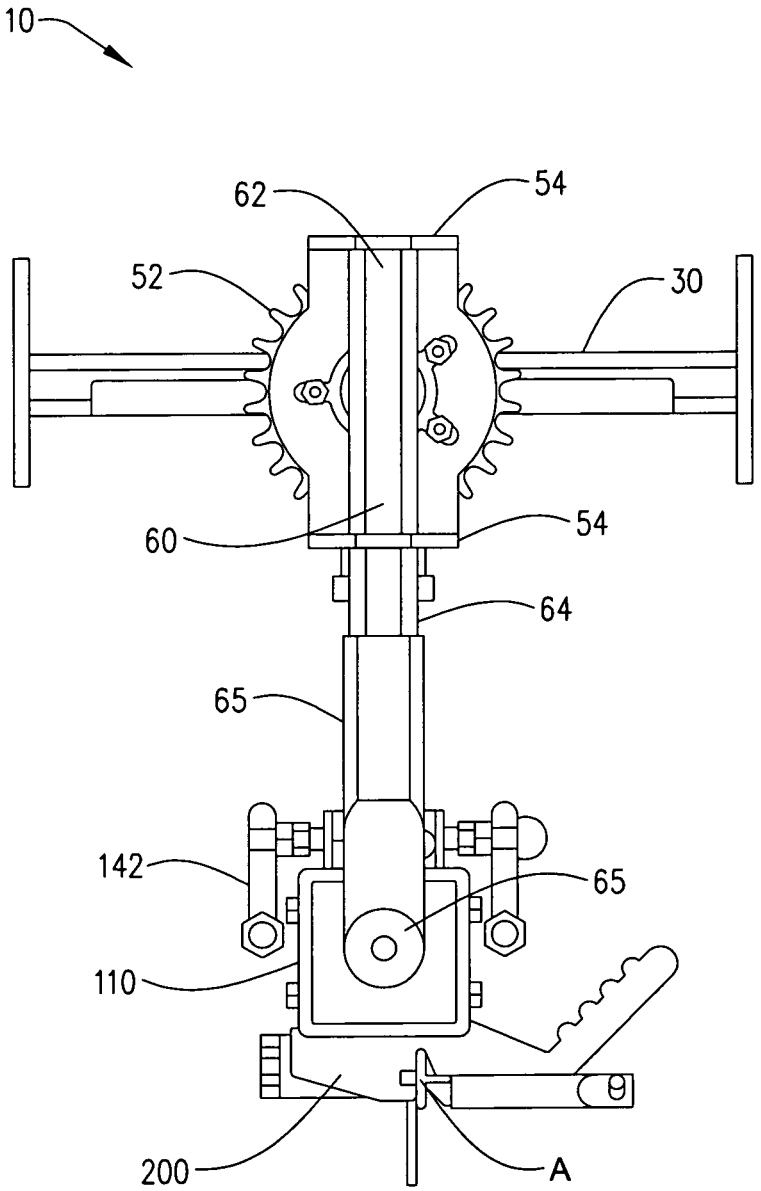
FIG. 4 is a top view of the T-post installation tool demonstrating the insertion of a T-post.

The tower support member 20 further comprises a hitch tower base 30 defining a pair of opposing lateral three point hitch supports 32, a singular upper three point hitch support 34, the three point hitch supports attaching to the supplied three point hitch of a tractor or other implement having a conventional hydraulic three point hitch using standard hitch pins, FIG. 5, the hitch tower base 30 extending a base tower receiver 35 and providing a chain anchor bracket 37 directed towards the tractor or implement and optionally providing an accessory receiver hitch 36, as shown in FIGS. 1-2 and 5. The tower support member 30 further provides an upper tower assembly 40 including a lower vertical insert section 42 which is secured within the base tower receiver 35 and an upper pivot base plate 44 pivotally attaching to a pivotal locking gear 52 by a horizontal plane bearing 50, the pivotal locking gear 52 being locked into a position by a spring locking pin 53 incorporated into the upper pivot base plate 44 in a position selected by the user, FIGS. 1-2 and 4-6, the pivotal locking gear 52 further extending at least two horizontal support arm brackets 54 which support a horizontal support arm 60 at a bracket end 62, the support arm 60 extending horizontally to a hitch end 64, the hitch end 64 defining the locking ball hitch 65.

The hydraulic ram assembly 100 further comprises a support encasement 110 defining an upper end 111 providing a plurality of axial end cap bolt holes 112, a lower end 113, a front surface 114, a right side surface 115, a left side surface 116, a rear surface 117 includes a lower vertical slide channel 118, the four side 114-117, defining an inner vertical channel 119 from the upper end 111 to the lower end 113, FIGS. 1, 3, and 7-9. Within the upper end 111, an upper end cap 120 is attached to the support encasement 110 by a plurality of anchor bolts 122 secured through the axial end cap bolt holes 112, FIGS. 9 and 15. The upper end cap 120 further defines the upper hitch ball 124 and provides a lower ram mounting support 126, FIGS. 9 and 15. The upper hitch ball 124 secures within the locking ball hitch 65 of the tower support member 20 in a pendulum-type engagement allowing the hydraulic ram assembly 100 to be positioned perpendicular to the ground for level placement of a T-post A into the ground.

Figure 15:
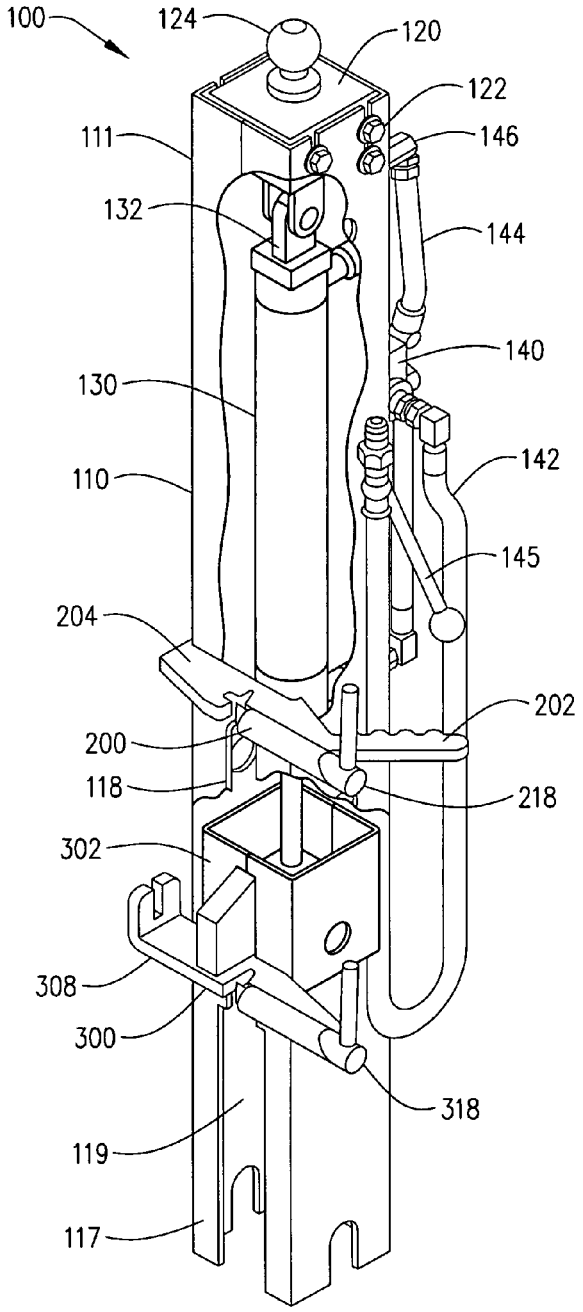
FIG. 15 is a perspective partial cutaway view of the ram cylinder attached between the lower ram support in the upper end cap and the inner encasement ram bracket.
Figure 16:
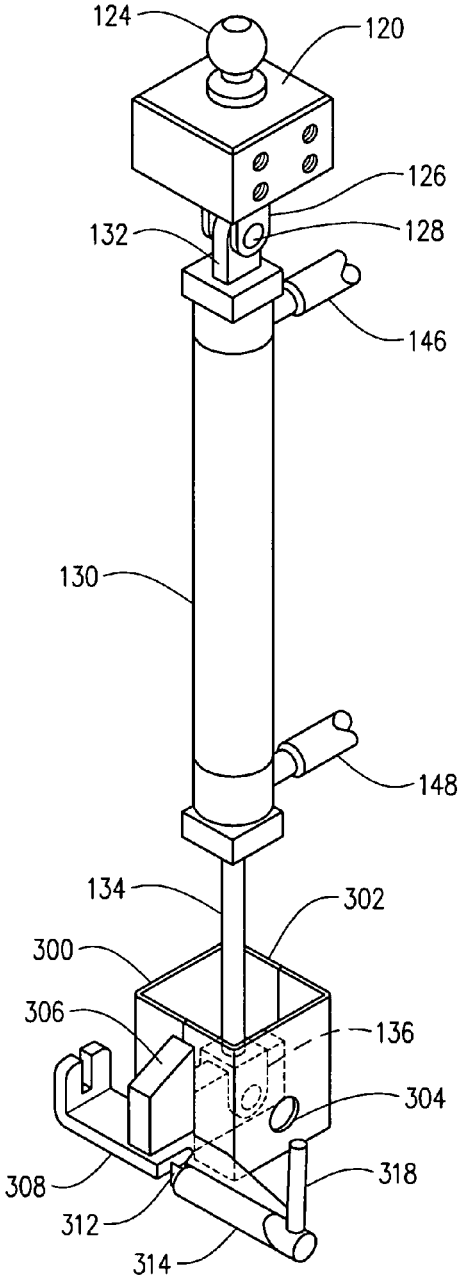
FIG. 16 is a perspective view of the upper end cap and lower drive T-post latch assembly with the hydraulic ram secured between the lower ram support and the rear bracket channel extension.

Suspended from within the inner vertical channel 119 of the support encasement 110 by the lower hydraulic ram support 126 is an upper pin mount 132 of a hydraulic ram cylinder 130, the upper pin mount 132 and the lower hydraulic ram support 126 connecting by a ram pin 128, FIGS. 15-16. The hydraulic ram cylinder 130 further defining a ram arm 134 having a lower pin mount 136. The hydraulic ram cylinder 130 is attached through an upper hose outlet 146 and a lower hose outlet 148 by hydraulic cylinder hoses 144 attaching to a hydraulic valve controller 140 attaching to the front surface 114 of the support encasement 110, the hydraulic valve controller 140 having an activation lever 145 to control the movement of the hydraulic ram cylinder 130, the hydraulic valve controller 140 further connecting to the hydraulic connections of a tractor or implement by hydraulic connector lines 142, FIGS. 1, 2 and 5. The activation lever 145 of the hydraulic valve controller 140 is directed either to the right side surface 115 or to the left side surface 116 of the support encasement 110 on the front surface 114, away from any moving components of the hydraulic ram assembly 110 later defined, FIG. 1.

The hydraulic ram assembly 100 further defines an upper stationary T-post latch assembly 200 attached to the rear surface 117 of the support encasement 110 above the lower vertical slide channel 118 and a lower drive T-post latch assembly 300 attaching to the lower pin mount 136 of the ram cylinder 130 through the lower vertical support channel 118, these two latch assemblies retaining a T-post A and providing the active driving means by which the T-post A is installed by force into the ground. The upper stationary T-post assembly 200 does not move in relation to the support encasement 110, FIGS. 7-8. The lower drive T-post latch assembly 300 moves in a vertical pathway within the lower vertical slide channel 118 as directed by the extension and retraction of the ram cylinder 130 as directed by the user having control of the activation lever 145 of the hydraulic valve controller 140, FIGS. 7-8.

The upper stationary T-post latch assembly 200 is attached to the rear surface 117 above the lower vertical slide channel 118 and further defines a latch base 204 forming a latch assembly grip post 202 extending laterally from the latch base 204, the latch base 204 being welded to the rear surface 117 on an inner conforming margin 203. The latch base 204 further defines an outer T-post slide channel 220 conforming to the profile of a vertical cross-section of a T-post A with an angular groove 222 accepting one of the laterals side sections B and a projection slide slot 224 which allows for the passage of the plurality of extending projections E of the captive T-post A, as indicated in FIGS. 1-4. A latch member 210 is presented between the T-post slide channel 220 and the grip post 202, the latch member 210 further defining a slide pin cylinder 214 attached to the latch base 204, the slide pin cylinder 214 containing a slide pin 216 having a rotational slide pin lever 218 and projecting a latch catch 212, the latch catch 212 spanning a portion of the T-post slide channel 220 in a closed position and fully clearing the T-post slide channel 220 in an open position, the latch catch extending towards the T-post A at the intersection of the rear section C and the lateral side section B away from the angular groove 222, the selection of the open and closed position being determined by the position of the slide pin lever 218, as seen in FIGS. 10-11 and 13-14.

Figure 12:
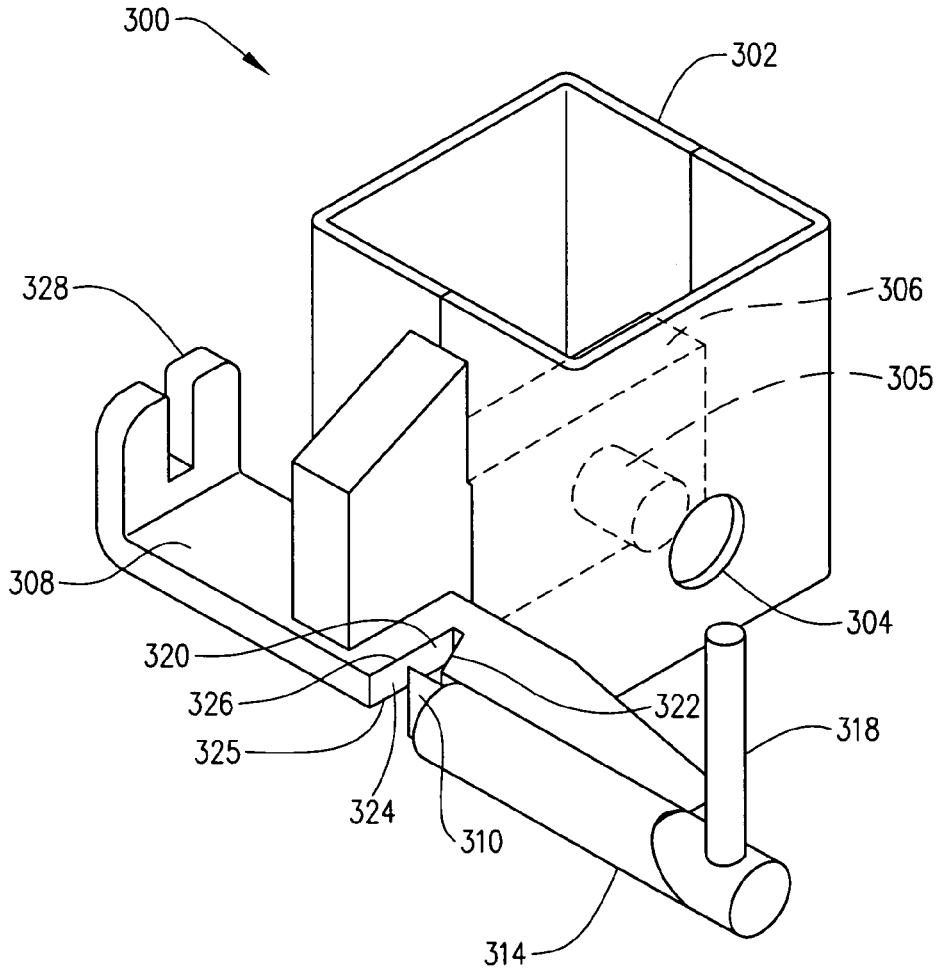
FIG. 12 is a perspective view of the inner encasement ram bracket attached to the lower drive T-post latch assembly.

The lower drive T-post latch assembly 300 further comprises an inner encasement ram bracket 302, conforming to the shape of the inner vertical channel 119 of the support encasement 110 to move freely up and down within the support encasement 110, the inner encasement ram bracket 302 further providing an axial bore 304 through which a ram arm pin 305 attaches the inner encasement ram bracket 302 to the lower pin mount 136 of the ram cylinder 130 suspended within the inner vertical channel 119. The inner encasement ram bracket 302 extends a rear bracket channel extension 306 through the lower vertical slide channel 118 beyond the rear surface 117 of the support encasement 110, as shown in FIG. 12. A latch base 308 is welded to the rear bracket channel extension 306 with the latch base 308 further defining a T-post drive channel 320. The T-post drive channel 320 is distinguished from the T-post slide channel 220 of the upper stationary T-post latch assembly 200, forming the same angular groove 322, but without a projection slide slot 224, instead forming a flat projection drive margin 324 presenting an upper edge 326 and a lower edge 325. This T-post drive channel 320 will conform to the vertical cross-section of a T-post A, with a lateral side section B within and the rear section C against the T-post drive channel 320, except the projection drive margin 324 will not allow the passage of the extending projections E of the T-post A, the projection drive margin 324 fitting between a selected pair of extending projections E against the flat front section D, the lower extending projections E below the projection drive margin 324 forced downward by the lower edge 325 of the projection drive margin 324.

Figure 13:
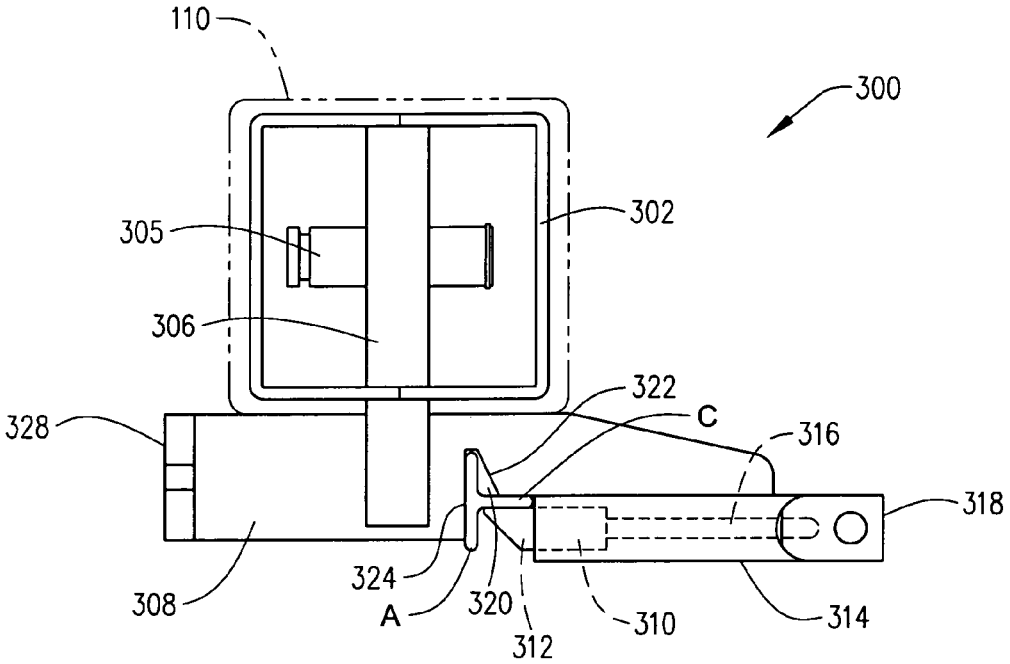
FIG. 13 is a cross-sectional view of the lower drive T-post latch assembly with the latch catch in a closed position showing a T-post.
Figure 14:
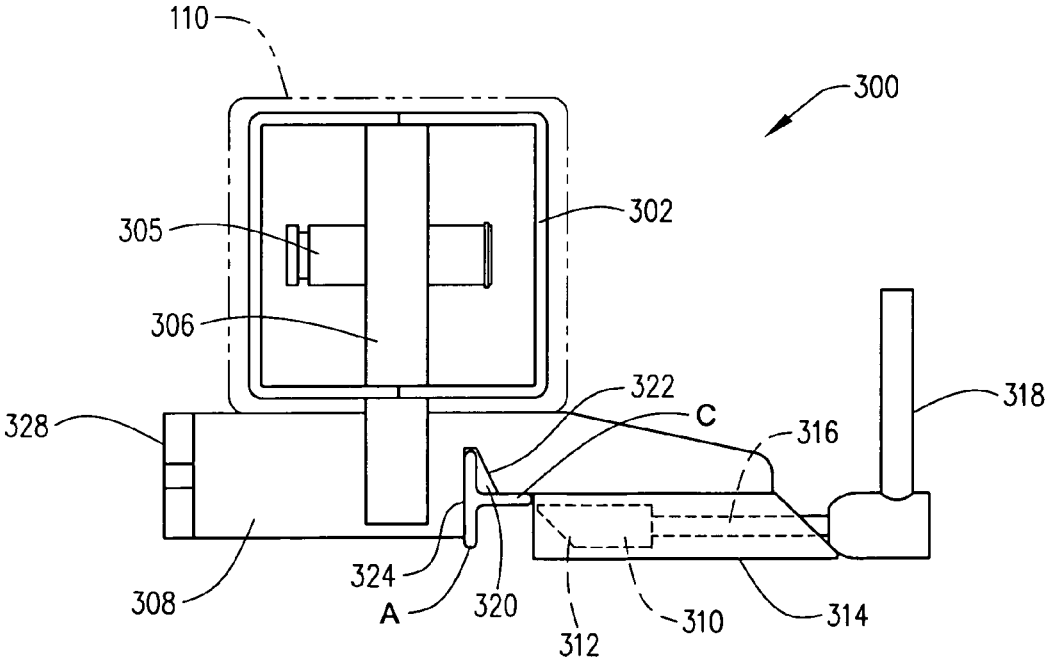
FIG. 14 is a cross-sectional view of the lower drive T-post latch assembly with the latch catch in an open position showing a T-post.

A latch member 310 is presented between the T-post drive channel 320 on a margin opposite the T-post drive channel 320 from the attachment between the rear bracket channel extension 306, the latch member 310 further defining a slide pin cylinder 314 attached to the latch base 308, the slide pin cylinder 314 retaining a slide pin 316 having a rotational slide pin lever 318 and projecting a latch catch 312. The latch catch 312 spans a portion of the T-post drive channel 320 in a closed position which intrudes into a portion of the T-post A, formed by the lateral side section B and the rear section C and fully clearing the T-post drive channel 320 in an open position, the selection of the open and closed position being determined by the position of the slide pin lever 318, as seen in FIGS. 13-14.

The T-post installation tool 10 can be used by a single user or by a user and a tractor driver as a team. Prior to attachment of the T-post installation tool 10 to a tractor, it is recommended that the tractor be turned off. Installation involves the steps commencing by connecting the tower support member 20 to the three point hitch and ensuring that all safety pins are engaged. The locking ball hitch 65 is opened and the hydraulic ram assembly 100 is placed in a vertical position with the upper hitch ball 124 up, the hitch ball 124 being installed within the locking ball hitch 65, further engaging the locking ball hitch 65 to capture and secure the upper hitch ball 124 within the locking ball hitch 65 and further installing and securing any hitch pin to lock the locking ball hitch 65 in a closed position. The rear surface 117 of the hydraulic ram assembly 100 is directed away from the tractor and the front surface 114 of the hydraulic ram assembly 100 is directed towards the tractor. At this point, the hydraulic connector lines 142 are attached to the tractor hydraulic system. It is advisable at this point that the user directs the horizontal support arm 60 away from the tractor and that the spring locking pin 53 locks the support arm 60 in this position by engaging the spring lock pin 53 in the appropriate location within the pivotal locking gear 52. At this point, the user may start the tractor. It may also be recommended that at this point that a chain be used to connect the optional chain anchor bracket 37, where supplied, to a sturdy section of the tractor, perhaps an extending hitch plate on the tractor, to prevent the T-post installation tool 10 from sudden rise during the start up of the tractor, commonly resulting in an upward lurch of the three point hitch and/or pressure in the hydraulic lines that might present unintentional movement to the hydraulic ram assembly 100. At this point, the T-post installation tool 10 is ready for use to install T-posts A. The chain may be left in place during use of the installation to retain the three point hitch at a certain level.

Installation of the T-post A using the T-post installation tool 10 requires a mere few steps. Caution should be taken in keeping hands away from any moving component during use of the tool 10. A user will position the tractor and attached tool 10 at the location where the T-post A is to be installed, placing the lower end 113 of the hydraulic ram assembly 100 adjacent to a T-post insertion site. The lever 145 of the hydraulic valve controller 140 is elevated until the lower drive T-post latch assembly 300 is at the top of the lower vertical slide channel 118, retracting the ram cylinder 130 to its most compressed state. A T-post A is then inserted into the T-post slide channel 220 and T-post drive channel 320 of respective upper stationary T-post latch assembly 200 and the lower drive T-post latch assembly 300 while each respective latch catch 212, 312, is in the open position, FIGS. 11 and 14. The projection drive margin 324 must be between two extending projections E of the inserted T-post A. The slide pin levers 218, 318, are then rotated to close the latch catches 212, 312, FIGS. 10 and 13. At this point, the user is to remove their hands from the rear surface area, especially away from the lower drive T-post latch assembly 300 and the lower vertical slide channel 118. If needed, the user may grasp the latch assembly grip post 202 to steady the hydraulic ram assembly 100 and to maintain the level of the T-post A during installation. Using another hand, the user would maneuver the activation lever 145 of the hydraulic valve controller 140 to lower the lower drive T-post latch assembly 300, driving the bottom end H and the twist plate F of the T-post A into the ground until the hydraulic ram cylinder 130 reaches its full extension or when the lower drive T-post latch assembly 300 is at the lower end 113 of the support encasement 110. The latch catches 212, 312, are then released and the hydraulic ram assembly 100 is moved to release the T-post A from the respective T-post slide channel 220 and T-post drive channel 320. The user then moves on to the next installation.

It is intended that the inner encasement ram bracket 302 is confined within the support encasement 110 at all times and that the design of the tool 10 be such that the return of the ram cylinder 130 be consistent with the length of the support encasement 110 so that the inner encasement ram bracket 302 is never completely pushed beyond the lower end 113 of the support encasement 110. At full extension, if the T-post A requires further insertion, the T-post A would be released from both respective angular grooves 222, 322, by unlatching the latch members 210, 310, and maneuvering the hydraulic ram assembly 100 using the latch assembly grip post 202 to release the T-post A, retracting the ram cylinder 130, reapplying the hydraulic ram assembly 100 to a higher point of the T-post A and repeat the driving of the T-post A until installed to the proper depth in the ground.

In addition to installation, the tool 10 may be used to remove a T-post A which is in the ground using the reverse installation steps, or by connecting a chain to the T-post A or any other post for that matter, further attaching the chain to a lateral slotted chain extension 328, shown in FIGS. 1, 5, 7, 12-14, and retracting the hydraulic ram 130, elevating the lower drive T-post latch assembly 300 and pulling the post out of the ground.

While the T-post installation tool 10 has been particularly shown and described with reference to a preferred embodiment thereof, it will be understood by those skilled in the art that changes in form and detail may be made therein without departing from the spirit and scope of the invention.

What is claimed is:

1. A T-post installation tool attaching to a tractor having a three point hitch and having hydraulic line connections to hydraulically driving a T-post into the ground without impact and without deformation to said T-post, said tool comprising:

a tower support member engaging a tractor further providing a hitch tower base defining a pair of opposing lateral three point hitch supports, a singular upper three point hitch support, said three point hitch supports attaching to said tractor or other implement having a common hydraulic three point hitch using standard hitch pins, said hitch tower base extending a base tower receiver and providing a chain anchor bracket directed towards said tractor or implement, said tower support member defining an upper tower assembly including a lower vertical insert section secured within said base tower receiver and an upper pivot base plate pivotally attaching a pivotal locking gear by a horizontal plane bearing, said pivotal locking gear secured into a position by a spring locking pin incorporated into said upper pivot base plate in a position selected a user, said pivotal locking gear further extending at least two horizontal support arm brackets supporting a horizontal support arm at a bracket end, said support arm extending horizontally to a hitch end defining a locking ball hitch;

a hydraulic ram assembly defining a support encasement with an upper end providing a plurality of axial end cap bolt holes, a lower end, a front surface, a right side surface, a left side surface, and a rear surface defining a lower vertical slide channel, said four side defining an inner vertical channel from said upper end to said lower end, said upper end cap attached to said support encasement by a plurality of anchor bolts secured through said axial end cap bolt holes, said upper end cap extending an upper hitch ball and a lower ram mounting support, said upper hitch ball secured within said locking ball hitch of said tower support member in a pendulum-type engagement allowing said hydraulic ram assembly to be positioned perpendicular to said ground for level placement of a T-post into said ground, said hydraulic ram assembly further defining an upper stationary T-post latch assembly attached to a rear surface of said support encasement above said lower vertical slide channel and a lower drive T-post latch assembly, these two said latch assemblies retaining said T-post in a vertical position and providing an active driving means by which said T-post is installed by force into said ground, said upper stationary T-post assembly being immovable in relation to said support encasement, said lower drive T-post latch assembly moving in a vertical pathway within said lower vertical slide channel as directed by an intentional extension and retraction of said active driving means as directed by said user having control of said active driver means, wherein said T-post is installed within said T-post slide channel of said upper stationary and said T-post drive channel of said lower drive T-post latch assemblies, with a projection drive margin forcing one of said plurality of extending projections of said T-post downward driving said T-post into said ground below said support encasement by activation of said active driving means by said user intentionally lowering said lower drive T-post latch assembly.

2. The T-post installation tool, as disclosed in claim 1, wherein said active driving means comprising:

a hydraulic ram cylinder suspended from within said inner vertical channel of said support encasement by a lower hydraulic ram support connecting an upper pin mount of said hydraulic ram cylinder, with a lower pin mount on a ram arm of said ram cylinder attaching to said lower drive T-post latch assembly; and said hydraulic ram cylinder is attached through an upper hose outlet and a lower hose outlet by hydraulic cylinder hoses attaching to a hydraulic valve controller attaching to said front surface of said support encasement, said hydraulic valve controller having an activation lever to control said movement of said hydraulic ram cylinder, said hydraulic valve controller further connecting to said hydraulic connections of a tractor or implement by hydraulic connector lines, said activation lever of said hydraulic valve controller directed either to said right side surface or to said left side surface of said support encasement on said front surface away from any moving components of said hydraulic active drive means.

3. The T-post installation tool, as disclosed in claim 1, wherein said active driving means comprising:

a hydraulic ram cylinder suspended from within said inner vertical channel of said support encasement by a lower hydraulic ram support connecting an upper pin mount of said hydraulic ram cylinder, with a lower pin mount on a ram arm of said ram cylinder attaching to said lower drive T-post latch assembly;

said hydraulic ram cylinder is attached through an upper hose outlet and a lower hose outlet by hydraulic cylinder hoses attaching to a hydraulic valve controller attaching to said front surface of said support encasement, said hydraulic valve controller having an activation lever to control said movement of said hydraulic ram cylinder, said hydraulic valve controller further connecting to said hydraulic connections of a tractor or implement by hydraulic connector lines, said activation lever of said hydraulic valve controller directed either to said right side surface or to said left side surface of said support encasement on said front surface away from any moving components of said hydraulic active drive means; and said hydraulic ram assembly further defines said upper stationary T-post latch assembly attached to said rear surface of said support encasement above said lower vertical slide channel and said lower drive T-post latch assembly attaching to said lower pin mount of said ram cylinder through said lower vertical support channel, wherein said two latch assemblies retain said T-post in a vertical orientation said upper stationary T-post assembly not moving in relation to said support encasement and said lower drive T-post latch assembly forced downward in a vertical pathway within said lower vertical slide channel as directed by said extension and retraction of said ram cylinder by said user having control of said activation lever of said hydraulic valve controller.

4. The T-post installation tool, as disclosed in claim 1, further comprising:

said upper stationary T-post latch assembly is attached to said rear surface above said lower vertical slide channel and further defines a latch base forming a latch assembly grip post extending laterally from said latch base, said latch base being welded to said rear surface on an inner conforming margin, said latch base further defining an outer T-post slide channel conforming to said profile of a vertical cross-section of a T-post with an angular groove accepting one of said laterals side sections and a projection slide slot which allows for said passage of said plurality of extending projections of said captive T-post, and a latch member presented between said T-post slide channel and said grip post, said latch member further defining a slide pin cylinder attached to said latch base, said slide pin cylinder containing a slide pin having a rotational slide pin lever and projecting a latch catch, said latch catch spanning a portion of said T-post slide channel in a closed position and fully clearing said T-post slide channel in an open position, said latch catch extending towards said T-post at said intersection of said rear section and said lateral side section away from said angular groove, said selection of said open and closed position being determined by said position of said slide pin lever; and said lower drive T-post latch assembly providing an inner encasement ram bracket, conforming a shape of said inner vertical channel of said support encasement to move freely up and down within said support encasement, said inner encasement ram bracket further providing an axial bore through which a ram arm pin attaches said inner encasement ram bracket to said lower pin mount of said ram cylinder suspended within said inner vertical channel, said inner encasement ram bracket extends a rear bracket channel extension through said lower vertical slide channel beyond said rear surface of said support encasement with a latch base welded to said rear bracket channel extension with said latch base further defining a T-post drive channel, distinguished from said T-post slide channel of said upper stationary T-post latch assembly, forming a same angular groove, but without a projection slide slot, instead forming a flat projection drive margin presenting an upper edge and a lower edge, said T-post drive channel conforming to said vertical cross-section of a T-post, with a lateral side section within and said rear section against said T-post drive channel, except said projection drive margin blocking said passage of said extending projections of said T-post, said projection drive margin installed between a selected pair of extending projections against said flat front section, said lower extending projections below said projection drive margin forced downward by said lower edge of said projection drive margin.

5. The T-post installation tool, as disclosed in claim 1, further comprising:

said lower drive T-post latch assembly providing an inner encasement ram bracket, conforming to said shape of said inner vertical channel of said support encasement to move freely up and down within said support encasement, said inner encasement ram bracket further providing an axial bore through which a ram arm pin attaches said inner encasement ram bracket to said lower pin mount of said ram cylinder suspended within said inner vertical channel, said inner encasement ram bracket extends a rear bracket channel extension through said lower vertical slide channel beyond said rear surface of said support encasement with a latch base welded to said rear bracket channel extension with said latch base further defining a T-post drive channel, distinguished from said T-post slide channel of said upper stationary T-post latch assembly, forming a same angular groove, but without a projection slide slot, instead forming a flat projection drive margin presenting an upper edge and a lower edge, said T-post drive channel conforming to said vertical cross-section of a T-post, with a lateral side section within and said rear section against said T-post drive channel, except said projection drive margin blocking said passage of said extending projections of said T-post, said projection drive margin installed between a selected pair of extending projections against said flat front section, said lower extending projections below said projection drive margin forced downward by said lower edge of said projection drive margin; and a latch member presented between said T-post drive channel on a margin opposite said T-post drive channel from said attachment between said rear bracket channel extension, said latch member further defining a slide pin cylinder attached to said latch base, said slide pin cylinder retaining a slide pin having a rotational slide pin lever and projecting a latch catch, said latch catch spanning a portion of said T-post drive channel in a closed position which intrudes into a portion of said T-post, formed by said lateral side section and said rear section and fully clearing said T-post drive channel in an open position, said selection of said open and closed position being determined by said position of said slide pin lever.

6. A T-post installation tool attaching to a tractor having a three point hitch and having hydraulic line connections to hydraulically driving a T-post into the ground without impact and without deformation to said T-post, said tool comprising:

a tower support member engaging a tractor further providing a hitch tower base defining a pair of opposing lateral three point hitch supports, a singular upper three point hitch support, said three point hitch supports attaching to said tractor or other implement having a common hydraulic three point hitch using standard hitch pins, said hitch tower base extending a base tower receiver and providing a chain anchor bracket directed towards said tractor or implement, said tower support member defining an upper tower assembly including a lower vertical insert section secured within said base tower receiver and an upper pivot base plate pivotally attaching a pivotal locking gear by a horizontal plane bearing, said pivotal locking gear secured into a position by a spring locking pin incorporated into said upper pivot base plate in a position selected a user, said pivotal locking gear further extending at least two horizontal support arm brackets supporting a horizontal support arm at a bracket end, said support arm extending horizontally to a hitch end defining a locking ball hitch;

a hydraulic ram assembly defining a support encasement with an upper end providing a plurality of axial end cap bolt holes, a lower end, a front surface, a right side surface, a left side surface, and a rear surface defining a lower vertical slide channel, said four side defining an inner vertical channel from said upper end to said lower end, said upper end cap attached to said support encasement by a plurality of anchor bolts secured through said axial end cap bolt holes, said upper end cap extending an upper hitch ball and a lower ram mounting support, said upper hitch ball secured within said locking ball hitch of said tower support member in a pendulum-type engagement allowing said hydraulic ram assembly to be positioned perpendicular to said ground for level placement of a T-post into said ground, said hydraulic ram assembly further defines an upper stationary T-post latch assembly attached to said rear surface of said support encasement above said lower vertical slide channel and a lower drive T-post latch assembly, these two said latch assemblies retaining a T-post in a vertical position and providing an active driving means by which said T-post is installed by force into said ground, said upper stationary T-post assembly being immovable in relation to said support encasement, said lower drive T-post latch assembly moving in a vertical pathway within said lower vertical slide channel as directed by an intentional extension and retraction of said active driving means as directed by said user having control of said active driver means, wherein said T-post is installed within said T-post slide channel of said upper stationary and said T-post drive channel of said lower drive T-post latch assemblies, with a projection drive margin forcing one of said plurality of extending projections of said T-post downward driving said T-post into said ground below said support encasement by activation of said active driving means by said user intentionally lowering said lower drive T-post latch assembly;

a hydraulic ram cylinder suspended from within said inner vertical channel of said support encasement by a lower hydraulic ram support connecting an upper pin mount of said hydraulic ram cylinder, with a lower pin mount on a ram arm of said ram cylinder attaching to said lower drive T-post latch assembly; and said hydraulic ram cylinder attached through an upper hose outlet and a lower hose outlet by hydraulic cylinder hoses attaching to a hydraulic valve controller attaching to said front surface of said support encasement, said hydraulic valve controller having an activation lever to control said movement of said hydraulic ram cylinder, said hydraulic valve controller further connecting to said hydraulic connections of a tractor or implement by hydraulic connector lines, said activation lever of said hydraulic valve controller directed either to said right side surface or to said left side surface of said support encasement on said front surface away from any moving components of said hydraulic active drive means.

7. The T-post installation tool, as disclosed in claim 6, wherein said active driving means comprising:

a hydraulic ram cylinder suspended from within said inner vertical channel of said support encasement by a lower hydraulic ram support connecting an upper pin mount of said hydraulic ram cylinder, with a lower pin mount on a ram arm of said ram cylinder attaching to said lower drive T-post latch assembly;

said hydraulic ram cylinder is attached through an upper hose outlet and a lower hose outlet by hydraulic cylinder hoses attaching to a hydraulic valve controller attaching to said front surface of said support encasement, said hydraulic valve controller having an activation lever to control said movement of said hydraulic ram cylinder, said hydraulic valve controller further connecting to said hydraulic connections of a tractor or implement by hydraulic connector lines, said activation lever of said hydraulic valve controller directed either to said right side surface or to said left side surface of said support encasement on said front surface away from any moving components of said hydraulic active drive means; and said hydraulic ram assembly further defines said upper stationary T-post latch assembly attached to said rear surface of said support encasement above said lower vertical slide channel and said lower drive T-post latch assembly attaching to said lower pin mount of said ram cylinder through said lower vertical support channel, wherein said two latch assemblies retain said T-post in a vertical orientation said upper stationary T-post assembly not moving in relation to said support encasement and said lower drive T-post latch assembly forced downward in a vertical pathway within said lower vertical slide channel as directed by said extension and retraction of said ram cylinder by said user having control of said activation lever of said hydraulic valve controller.

8. The T-post installation tool, as disclosed in claim 6, further comprising:

said upper stationary T-post latch assembly is attached to said rear surface above said lower vertical slide channel and further defines a latch base forming a latch assembly grip post extending laterally from said latch base, said latch base being welded to said rear surface on an inner conforming margin, said latch base further defining an outer T-post slide channel conforming to said profile of a vertical cross-section of a T-post with an angular groove accepting one of said laterals side sections and a projection slide slot which allows for said passage of said plurality of extending projections of said captive T-post, and a latch member presented between said T-post slide channel and said grip post, said latch member further defining a slide pin cylinder attached to said latch base, said slide pin cylinder containing a slide pin having a rotational slide pin lever and projecting a latch catch, said latch catch spanning a portion of said T-post slide channel in a closed position and fully clearing said T-post slide channel in an open position, said latch catch extending towards said T-post at said intersection of said rear section and said lateral side section away from said angular groove, said selection of said open and closed position being determined by said position of said slide pin lever; and said lower drive T-post latch assembly providing an inner encasement ram bracket, conforming a shape of said inner vertical channel of said support encasement to move freely up and down within said support encasement, said inner encasement ram bracket further providing an axial bore through which a ram arm pin attaches said inner encasement ram bracket to said lower pin mount of said ram cylinder suspended within said inner vertical channel, said inner encasement ram bracket extends a rear bracket channel extension through said lower vertical slide channel beyond said rear surface of said support encasement with a latch base welded to said rear bracket channel extension with said latch base further defining a T-post drive channel, distinguished from said T-post slide channel of said upper stationary T-post latch assembly, forming a same angular groove, but without a projection slide slot, instead forming a flat projection drive margin presenting an upper edge and a lower edge, said T-post drive channel conforming to said vertical cross-section of a T-post, with a lateral side section within and said rear section against said T-post drive channel, except said projection drive margin blocking said passage of said extending projections of said T-post, said projection drive margin installed between a selected pair of extending projections against said flat front section, said lower extending projections below said projection drive margin forced downward by said lower edge of said projection drive margin.

9. The T-post installation tool, as disclosed in claim 6, further comprising:

said lower drive T-post latch assembly providing an inner encasement ram bracket, conforming to said shape of said inner vertical channel of said support encasement to move freely up and down within said support encasement, said inner encasement ram bracket further providing an axial bore through which a ram arm pin attaches said inner encasement ram bracket to said lower pin mount of said ram cylinder suspended within said inner vertical channel, said inner encasement ram bracket extends a rear bracket channel extension through said lower vertical slide channel beyond said rear surface of said support encasement with a latch base welded to said rear bracket channel extension with said latch base further defining a T-post drive channel, distinguished from said T-post slide channel of said upper stationary T-post latch assembly, forming a same angular groove, but without a projection slide slot, instead forming a flat projection drive margin presenting an upper edge and a lower edge, said T-post drive channel conforming to said vertical cross-section of a T-post, with a lateral side section within and said rear section against said T-post drive channel, except said projection drive margin blocking said passage of said extending projections of said T-post, said projection drive margin installed between a selected pair of extending projections against said flat front section, said lower extending projections below said projection drive margin forced downward by said lower edge of said projection drive margin; and a latch member presented between said T-post drive channel on a margin opposite said T-post drive channel from said attachment between said rear bracket channel extension, said latch member further defining a slide pin cylinder attached to said latch base, said slide pin cylinder retaining a slide pin having a rotational slide pin lever and projecting a latch catch, said latch catch spanning a portion of said T-post drive channel in a closed position which intrudes into a portion of said T-post, formed by said lateral side section and said rear section and fully clearing said T-post drive channel in an open position, said selection of said open and closed position being determined by said position of said slide pin lever.

10. The T-post installation tool, as disclosed in claim 6, said lower drive T-post latch assembly further comprising:

a lateral slotted chain extension to receive a chain or cord attached to a T-post or another object providing said tool an alternate capability to lift an object in addition to said installation of a T-post, using said hydraulic ram in a lowered position while said lower drive T-post latch assembly is at its lowest position and elevating said lower drive T-post latch assembly upward through said lower vertical slide channel, lifting said T-post or other object connected to said lateral slotted chain extension, hereby enabling said T-post installation tool to be used as a pulling or lifting tool.

* * * * *